US008556125B2

(12) United States Patent
Dapper

(10) Patent No.: US 8,556,125 B2
(45) Date of Patent: Oct. 15, 2013

(54) PORTABLE, NON-LETHAL, SELF DEFENSE DEVICE WITH DISABLING MECHANISM

(76) Inventor: Charles P Dapper, East Bethel, MN (US)

( * ) Notice: Subject to any disclaimer, the term of this patent is extended or adjusted under 35 U.S.C. 154(b) by 171 days.

(21) Appl. No.: 12/880,969

(22) Filed: Sep. 13, 2010

(65) Prior Publication Data

US 2011/0210146 A1 Sep. 1, 2011

Related U.S. Application Data

(60) Provisional application No. 61/308,088, filed on Feb. 25, 2010.

(51) Int. Cl.
*B67B 1/00* (2006.01)

(52) U.S. Cl.
USPC ..... 222/153.11; 222/113; 222/173; 222/192; 222/39

(58) Field of Classification Search
USPC ..... 222/113, 175, 192, 153.11, 39, 391
See application file for complete search history.

(56) References Cited

U.S. PATENT DOCUMENTS

| | | | | | |
|---|---|---|---|---|---|
| 3,828,982 | A * | 8/1974 | Steigerwald | 222/153.11 |
| 4,153,927 | A * | 5/1979 | Owens | 362/99 |
| 5,310,086 | A * | 5/1994 | Julinot | 222/1 |
| 5,476,192 | A * | 12/1995 | Julinot | 222/78 |
| 5,531,359 | A * | 7/1996 | Winner | 222/153.11 |
| 5,549,220 | A * | 8/1996 | Whalen | 222/1 |
| 5,556,003 | A * | 9/1996 | Johnson et al. | 222/39 |
| 6,439,432 | B1 * | 8/2002 | Park | 222/113 |
| 2002/0108966 | A1 * | 8/2002 | Park | 222/113 |
| 2007/0194048 | A1 * | 8/2007 | Teig | 222/113 |
| 2007/0205223 | A1 * | 9/2007 | Hansen | 222/192 |
| 2010/0237098 | A1 * | 9/2010 | Kaufman | 222/113 |

* cited by examiner

*Primary Examiner* — Kevin P Shaver
*Assistant Examiner* — Michael J Melaragno
(74) *Attorney, Agent, or Firm* — Geiser Law, PLLC; Greg N. Geiser

(57) ABSTRACT

A personal self defense device containing a housing, grip section, canister, actuator, a slide plate, and disarming device. The disarming device prevents operation of the device should the device be removed from the grasp of a victim. The disarming device can rotate in several directions and the force required for its operation can be adjusted. The device further includes a camera, illumination device, power source, and memory storage device.

7 Claims, 5 Drawing Sheets

PORTABLE, NON-LETHAL, SELF DEFENSE DEVICE WITH DISABLING MECHANISM

CROSS REFERENCE TO RELATED APPLICATIONS

This application claims the benefit of provisional patent application Ser. No. 61/308,808, filed 2010 Feb. 25 by the present inventor.

FEDERALLY SPONSORED RESEARCH

Not Applicable

SEQUENCE LISTING OR PROGRAM

Not Applicable

FIELD OF THE INVENTION

The present invention relates to a non-lethal self defense device that uses a chemical spray to disable a potential attacker.

BACKGROUND OF THE INVENTION

Since the beginnings of time, individuals have felt the need to defend themselves from others who might be attempting to harm them. Often a potential victim is forced to either submit to the attacker or try and defend themselves. While defending themselves an individual may use a weapon or security device to gain an advantage over a potential attacker, if they happen to be carrying a self defense device at the time of the attack. Ideally, this device will be non-lethal allowing the potential victim to escape from harm without permanently injuring the attacker.

One method of non-lethal self defense is to spray the attacker with a chemical that causes a burning or pain sensation. This chemical enters the attacker's mucous membranes and temporarily stuns the attacker, providing the potential victim much needed time to escape and reach an area of safety. During this attack it is desirable for the device to be unable to function should an attacker remove the device from the grasp of the victim.

U.S. Pat. No. 5,310,086 shows a canister holder for an aerosol device that is disarmed when the canister support is removed from the canister holder, but the canister support is only removable in one direction and does not provide a mechanism to adjust the removal tension. U.S. Pat. No. 5,531,359 shows a housing for holding an aerosol canister that includes a removable arming member that prevents the operation of the device upon removal of the arming member, but the arming member is only removable in one direction, can be easily armed without the use of the arming member, does not allow the user to adjust the amount of tension required to remove the arming mechanism, and will not work with a material that does not flex.

Although there are a few personal self defense devices with disarming capabilities, there is absent from the art a device that allows disarming in multiple directions and provides the user the ability to adjust the tension required to disarm the device, while at the same time offering convenience of use and ease of manufacture. In addition, a device is needed that offers a disarming feature and the ability to capture an image of an attacker to be used for identification purposes.

SUMMARY OF THE INVENTION

A device is provided that dispenses a chemical spray to protect the user from potential attackers. This device contains a mechanism that disables the device if it is taken away from a potential victim during a struggle. More specifically, the mechanism is attached to a key ring, the user's hand or wrist, or the worn around the user's neck, and when an adequate amount of force is applied to the device to remove it from the user, the device will separate from the user and at the same time be disabled from operation.

According to one embodiment of the invention, a device includes a canister assembly containing a chemical such as pepper spray or other non-lethal irritant. A housing comprising a front canister assembly support structure and rear canister assembly support structure partially encapsulates the canister assembly. The canister assembly includes a valve and hollow valve stem. The valve stem is moveable relative to the canister in an extended closed position and compressed open position. Depression of the valve stem will open the valve and allow propellant to escape the canister and enter the atmosphere.

An actuator is disposed on the valve stem and includes a nozzle and through orifice. The through orifice of the actuator establishes open communication between the nozzle and valve stem, wherein depression of the actuator will allow fluid to flow through the valve, valve stem, through orifice and into the nozzle.

The housing further comprises a front wall and grip section. Front wall includes an aperture through the housing and aligned with the nozzle, wherein fluid leaving the nozzle will travel through the aperture and enter the atmosphere, disabling a potential attacker outside the housing. The grip section extends the length of the canister and terminates at a bottom section of the housing. The grip section includes a shaft. The shaft is moveable in a direction parallel to the canister. The shaft integrity is protected by transverse support ribs perpendicular to the canister within the grip section to provide further structure and support to the interior components of the housing. In one embodiment of the present invention, the shaft contains a spline which is moveably received in a channel extending parallel the length of the canister and through the transverse support ribs. In addition an elastic member may be disposed on the shaft and biased in a direction parallel to the shaft to aid its movement.

The shaft has a bottom end and top end. Bottom end terminates at the bottom section. The shaft top end includes an inclined block. Inclined block is inclined at an angle between 0 degrees and 90 degrees from parallel to the shaft and opposite the canister.

Bottom section includes a canister lip, socket, and means to adjust the socket. Canister lip encapsulates the bottom of the canister to aid in securing the canister within the housing. A ball is received in the socket and supports the shaft. The ball places pressure on the shaft and loads an elastic member. The ball has an upper end and lower end. The lower end includes a stud with a through bore. The through bore allows for the attachment of objects to the stud including, key rings, wrist straps, lanyards, neck straps, arm straps and other similar means for attachment to a user. The means to adjust the socket allows the user adjust the amount of tension or force required to remove the ball from the socket. In the preferred embodiment the means to adjust the socket comprises an assembly of a helical spring and screw which tighten or loosen the housing which is assembled in two halves. The ideal range of tension is between 5 and 30 pounds of force required to remove the ball from the socket. Although a helical spring and screw are the preferred means to adjust the socket size and keep the ball in the socket, other means to keep the ball in the socket may include a latch, pin, stop, magnet or other similar combination.

A ball and socket connection is the preferred embodiment as it allows the housing to be manipulated in several directions while still being engaged within the socket. In addition, the ball and socket connection allows the ball to be pulled out of the socket from a variety of angles should a struggle ensue between the user and attacker.

The housing further comprises a channel perpendicular to the canister extending from the front wall to a rear wall. A slide plate is movably received in this channel. Slide plate comprises a central actuator aperture and incline aperture. The central actuator aperture is similarly sized to the actuator and positioned below the actuator, wherein depression of the actuator will pass through the central aperture of the slide plate compressing the valve stem and allowing the discharge of propellant. The incline aperture is located above the incline block and shaped to slidably receive the incline block, wherein slidable receipt of the incline block into the incline aperture moves the slide plate in a direction perpendicular to canister assembly. The slidable movement of the slide plate displaces the central actuator aperture in relation to the actuator, wherein the actuator cannot be depressed, preventing compression of the valve stem and therefore preventing propellant from exiting canister. The actuator will be able to be depressed when the incline block is slidably engaged with the incline aperture. When the ball is removed from the socket, the incline block will slide downward along with the shaft and displace the slide plate relative to the actuator.

Slide plate further comprises an indicator. The indicator is visible via a through hole in the housing, wherein the user can visibly determine the position of the slide plate relative to the actuator based upon this indicator. In the preferred embodiment, this indicator is mounted on the side of the slide plate and consists of the colors green and red. When the color green is visible in the through hole in the housing the actuator will be able to move through the slide plate and disperse the propellant. When red is visible, the actuator and slide plate central aperture will not be aligned and the actuator will not be able to compress the valve stem allowing for the dispersal of propellant.

Housing further comprises a top wall. Top wall is adapted via an appropriately sized cylindrical bore to receive the pivotally attached top flap. Top flap comprises a hinge pin adapted to pivotally attach top flap to the cylindrical bore of the housing. The top wall includes a stop to align the top flap with the top wall and to prevent the top flap from contacting the actuator. The top flap is pivotally moveable in a direction upwards from the housing allowing the user access to the actuator, wherein the actuator cannot be accessed by the user until the top flap is pivotally moved upwards.

In the preferred embodiment, the top flap is snap fit into the cylindrical bore. Although snap fit is the preferred embodiment, due to its simplicity, the hinge pin could also be spring loaded to automatically move the top flap downward to the stop after the top flap has been lifted to access the actuator. This spring will also allow the top flap to be forcefully engaged with the stop preventing accidental depression of the actuator when the device is placed into a users pocket, bag, purse, or other enclosed article.

In a further embodiment the top flap is communication with a gate adjacent to the aperture of the front wall, wherein manipulation of the top flap will move the gate. An upwards movement of the top flap will open the gate allowing the propellant to exit the aperture. A downward movement of the top flap will close the gate and prevent the accidental discharge of propellant and prevent debris from entering the nozzle or housing to prevent malfunction.

It is preferred that the housing is made of two halves of injection molded material, which pieces are joined together by mutually compatible male/female interlocking joints. These joints may be friction fit, snap fit, the combination of a threaded hole and screw, or other similar conntection that tightly secures the two halves. This combination will securely hold the canister within the housing and prevent the removal of the canister from the housing.

According to another embodiment of the invention, the housing includes a camera in communication with the actuator, a light source or flash in communication with the actuator, a memory storage device, a USB port, and a power source. A depression of the actuator will result in the release of chemical spray and at the same time take an illuminated picture that is stored on the device memory, where it can be accessed by the user or authorities for later identification of the attacker. In addition, other devices could be placed into the housing to enable the user to properly aim the device, such as a laser sight.

According to another embodiment of the invention, the housing also includes an audible generating device and speaker in communication with a power source and the actuator. When the trigger is depressed an audible noise is also heard to attempt and alert others to the attack and scare away the attacker.

BRIEF DESCRIPTION OF THE SEVERAL VIEWS OF THE DRAWING(S)

The accompanying drawings are included to provide a further understanding of the present invention and are incorporated in and constitute a part of this specification. The drawings illustrate exemplary embodiments of the present invention and together with the description serve to further explain the principles of the invention. Other aspects of the invention and the advantages of the invention will be better appreciated as they become better understood by reference to the Detailed Description when considered in conjunction with accompanying drawings, and wherein.

DETAILED DESCRIPTION OF THE INVENTION

Figure 1:
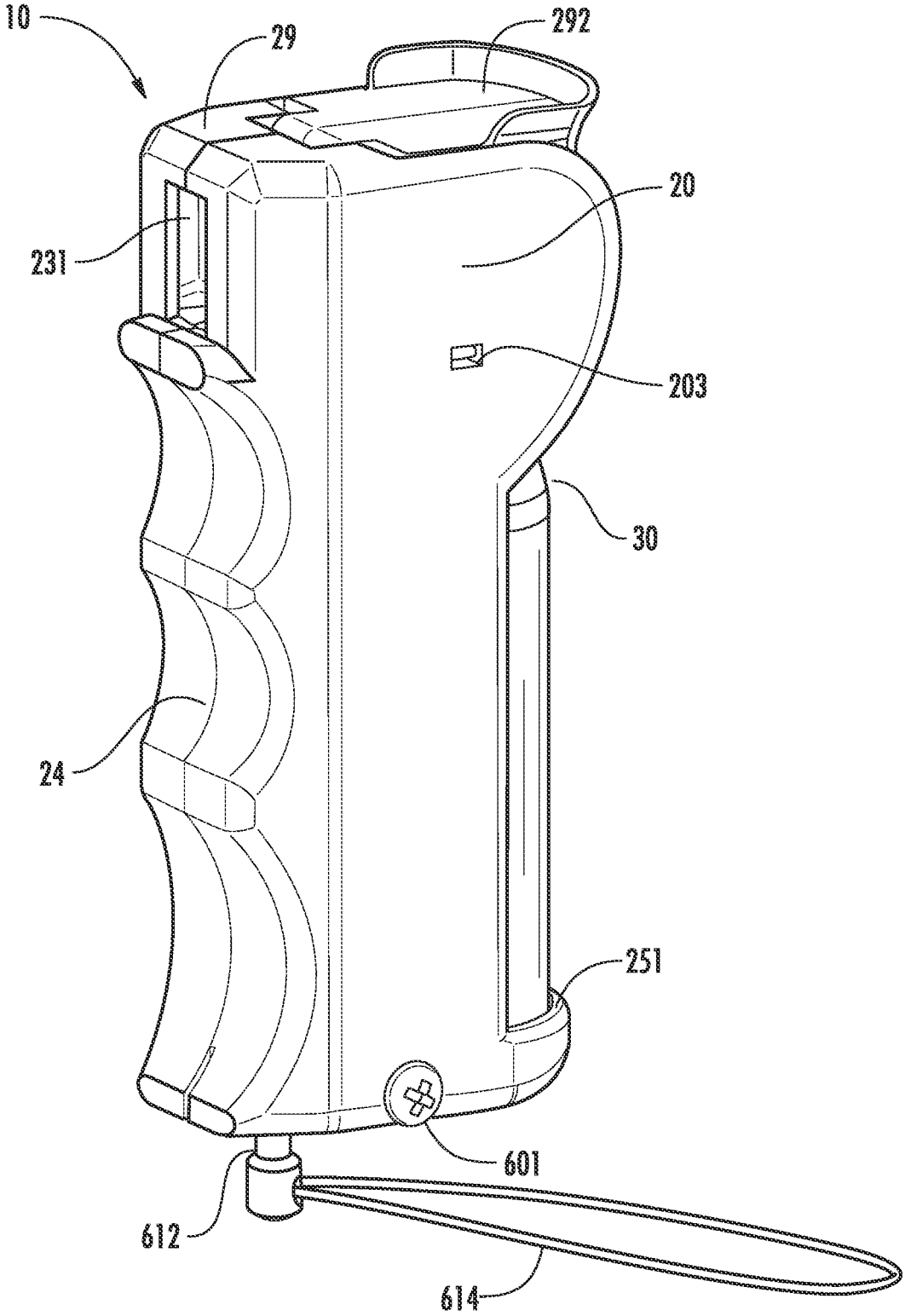
FIG. 1 is a perspective view of device, according to the present invention.
Figure 2:
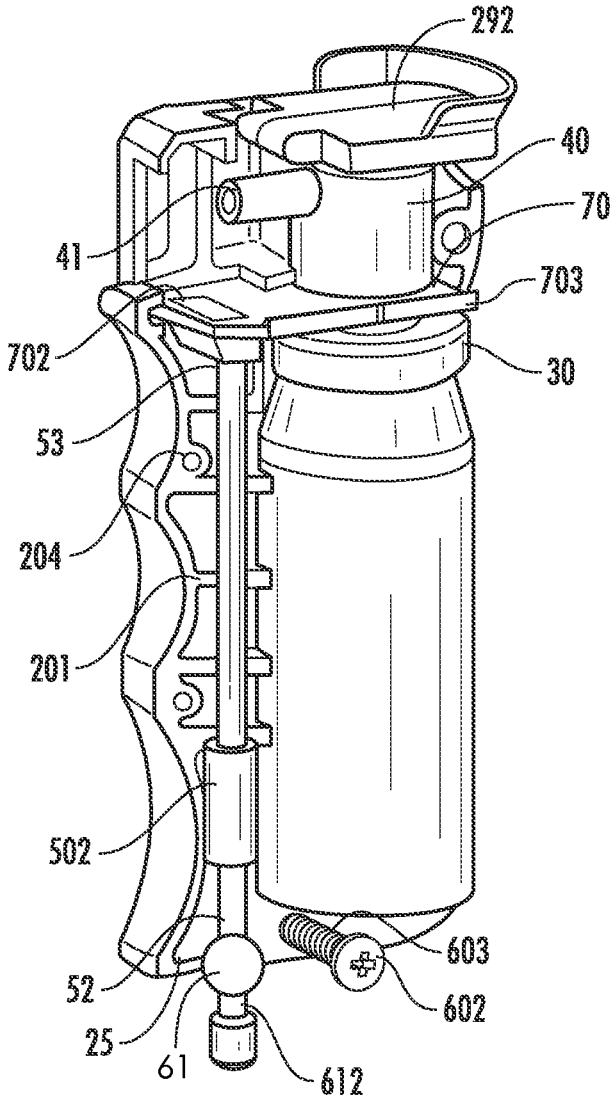
FIG. 2 is a perspective cross sectional view of the device, according to the present invention.
Figure 3:
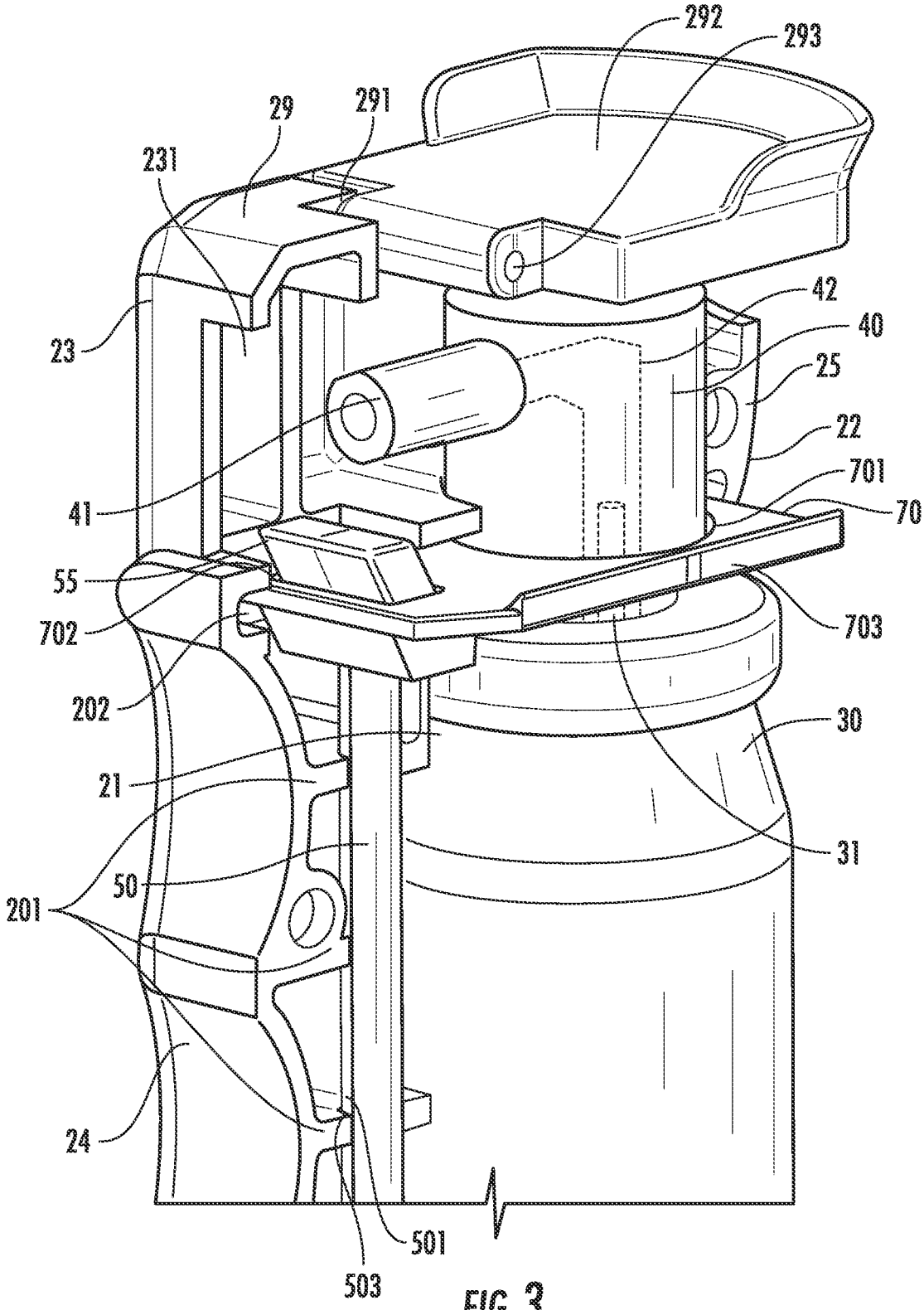
FIG. 3 is a perspective cross sectional view of the top half of the device, according to the present invention.
Figure 4:
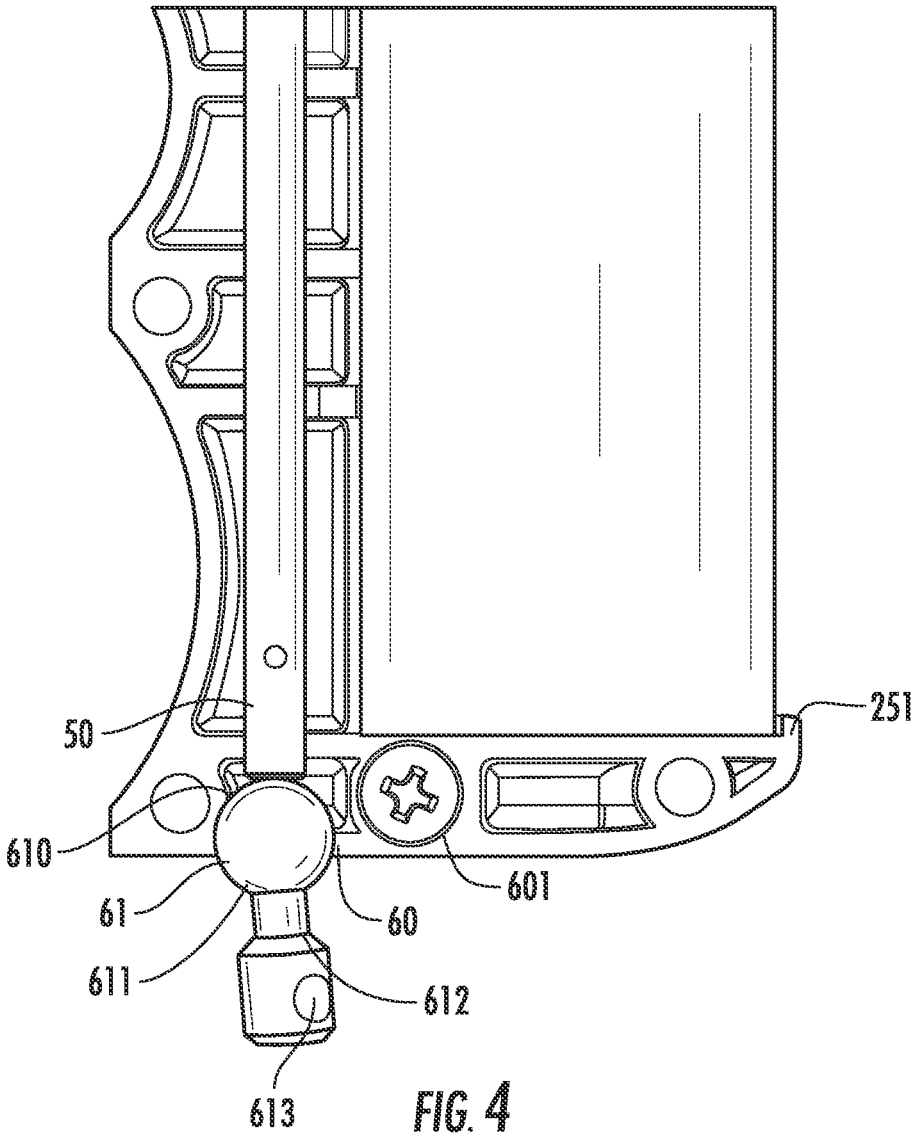
FIG. 4 is a cross sectional side view of the bottom view of the device, according to the present invention.

Referring now to FIGS. 1-4 there is shown an embodiment of the self defense device of the present invention, generally designated by the reference numeral 10. Housing 20 comprises a front canister assembly support structure 21 and rear canister assembly support structure 22, which structures securely attach a canister assembly 30 within the housing. Canister assembly 30 is not completely encapsulated within the housing 20 with a majority of its body length and sidewalls being visible and located outside housing 20. Canister assembly 30, for example, contains an aerosolized propellant with an irritant, and comprises a valve and hollow valve stem 31. The valve stem 31 is movable relative to the canister between an extended closed position and compressed open position in which propellant is free to leave the canister.

An actuator 40 is disposed on the valve stem 31 and includes a nozzle 41. The actuator 40 has a through orifice 42 adapted to establish open communication between the valve stem 31 and the nozzle 41, wherein depression of the actuator 40 will compress the valve stem 31, open the valve, and allow propellant to be dispersed through the nozzle 41. The housing 20 further comprises a front wall 23 and a grip section 24. The front wall 23 includes an aperture 231 aligned with the nozzle 41, wherein fluid exiting the nozzle 41 will travel through the aperture 231 and enter the atmosphere outside the housing 20. The grip section 24 extends the length of the canister assembly and terminates at the bottom section 25 of the housing 20. The grip section 24 further includes a shaft 50. The shaft 50 is moveable in a direction parallel to the canister assembly 30. The integrity of the shaft is supported by transverse support ribs 201 perpendicular to the canister assembly 30 within the grip section 24 to provide structure and support for the interior components of the housing 20. In one embodiment, the shaft contains a spline 501 which is moveably received in a notch 503 in the transverse support ribs 201. The shaft 50 further comprises an elastic member 502 biased in a direction parallel to the shaft 50 to aid in the movement of the shaft 50.

The shaft 50 has a bottom end 52 and a top end 53. The bottom end 52 terminates at the bottom section 25. The shaft top end 53 includes an inclined block 55. The inclined block 55 is inclined at an angle greater than 0 degrees and less than 90 degrees from parallel to the shaft 50 and opposite the canister assembly 30.

The bottom section 25 includes a canister lip 251, a socket 60, and a means to adjust the socket diameter 601. A ball 61 is received in the socket 60 and supports the shaft 50. The ball 61 in the socket 60 places pressure onto the shaft 50 and loads the elastic member 502. The ball 61 has an upper end 610 and a lower end 611. The lower end 611 includes a stud 612 with a bore 613. The bore 613 allows for the attachment of objects such as a key king, wrist strap 614, neck strap, arm strap or other such looped device easily attached to the user of the device.

The means to adjust the socket diameter 601 puts tension on the ball 61 in the socket 60 allowing the user to adjust the amount of force required to remove the ball from the socket. In the preferred embodiment, adjustment means 601 consists of a screw 602 and spring 603 which tightens the socket around the ball by flexing the housing. This combination allows the tension to be adjusted to between 5 and 30 pounds of force required to remove the ball from the socket. Ball 61 can be re-inserted into the socket 60 after it has been removed. Although the socket 60 and ball 61 connection can be tightened it is desired that the tension not be enough to prevent movement of the ball within the socket. The ideal tension is one that allows the ball to move freely within the socket, while at the same time requiring force to be removed. Five to thirty pounds of force is the ideal range of tension as it allows the ball to rotate in the socket during normal use but will still allow the ball to be separated from the socket during a struggle. Other adjustment means 601 could include a tab, slide, pin, latch, or other like mechanism which could increase the amount of tension necessary to remove the ball.

The ball 61 and socket 60 connection is the preferred embodiment as it allows the housing 20 to be manipulated in several directions while the ball 61 will remain engaged within the socket 60. In addition, the ball 61 and the socket 60 connection allows the ball 61 to be pulled out of the socket 60 from a variety of angles should a struggle ensue between the user and attacker.

The housing 20 comprises a channel 202 perpendicular to the canister assembly 30 extending from the front wall 23 to the rear wall 25. A slide plate 70 is moveably received in the channel 202. The slide plate 70 comprises a central actuator aperture 701 and a incline aperture 702. The central actuator aperture 701 is positioned below the actuator 40 and the central actuator aperture 701 and the actuator 40 are of a similar shape wherein depression of the actuator 40 will pass through the central aperture 701 and the slide plate 70 compressing the valve stem and allowing the discharge of propellant. The incline aperture 702 is located above the incline block 55 and correspondingly shaped to receive the incline block 55, wherein slidable receipt of the incline block 55 into the incline aperture 702, moves the slide plate 70 in a direction perpendicular to the canister assembly 30. The slidable movement of the side plate 70 displaces the central actuator aperture 701 in relation to the actuator 40 wherein the actuator cannot be depressed, preventing compression of the valve stem and therefore preventing propellant from exiting canister.

Slide plate 70 further comprises an indicator 703. The indicator 703 is visible via a through hole 203 in the housing 20, wherein the user can visibly determine the position of the slide plate 70 relative to the actuator 40 based upon this indicator. In the preferred embodiment, this indicator 703 is mounted on the side of the slide plate 70 and consists of the colors green and red. When the color green is visible in the through hole 203 in housing 20 the actuator 40 will be able to move through slide plate 70 and disperse the propellant. When red is visible, the actuator 40 and slide plate central actuator aperture 701 will not be aligned and the actuator 40 will not be able to compress the valve stem allowing for the dispersal of propellant. Although the colors red and green are the preferred indicator, other color or symbol combinations may used to designate when the device is able to be operated and when it is not.

Housing 20 further comprises a top wall 29. Top wall 29 is adapted via an appropriately sized cylindrical bore 291 to receive the pivotally attached top flap 292. The area below top flap 292 is open to allow the user access to actuator 40. Top flap 292 comprises a hinge pin 293 adapted to pivotally attach top flap 292 to the cylindrical bore 291 of housing 20. The top wall 29 includes a stop to align the top flap 292 with the top wall 29 and to prevent the top flap 292 from contacting the actuator 40. The top flap 292 is pivotally moveable in a direction upwards from the housing allowing the user access to the actuator 40, wherein the actuator 40 cannot be accessed by the user until the top flap 292 is pivotally moved upwards. Although a snap fit between the top flap 292 and cylindrical bore 291 is the preferred embodiment, due to its simplicity, the hinge pin 293 could be spring loaded to automatically move the top flap 292 downward to the stop after the top flap 292 has been lifted to access the actuator 40. This spring will also allow the top flap 292 to be forcefully engaged with the stop preventing accidental depression of the actuator when the device is placed into a users pocket, bag, purse, or other enclosed article.

In a further embodiment, the top flap 292 is communication with a gate adjacent to the aperture of the front wall, wherein manipulation of the top flap will move the gate. An upwards movement of the top flap 292 will open the gate allowing the propellant to exit the aperture 231. A downward movement of the top flap 292 will close the gate and prevent the accidental discharge of propellant and prevent debris from entering the nozzle or housing to prevent malfunction.

It is preferred that the housing 20 is made of two halves of injection molded material, which pieces are joined together by mutually compatible male/female interlocking joints 204. These joints may be friction fit, snap fit, threaded and screwed, or other joint combination that tightly secures the two halves. It is desired that the combination of joints securely hold the canister within the housing and prevent the removal of the canister from the housing.

Figure 5:
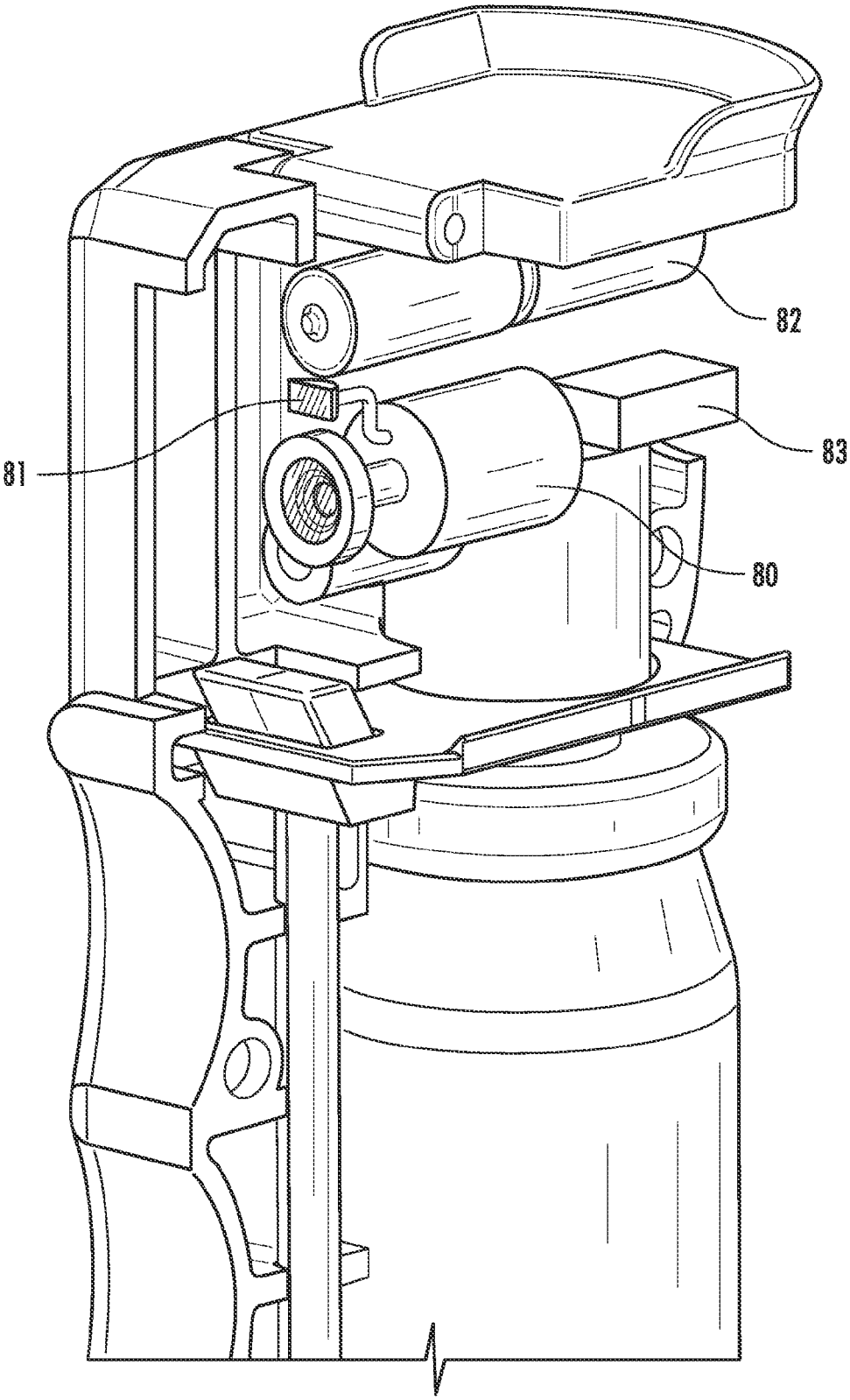
FIG. 5 is perspective cross sectional view of the top half of an additional embodiment, according to the present invention.

Referring now to FIG. 5, another embodiment of the device is shown. In this embodiment, housing 20 includes a camera 80, a light unit 81, a power source 82, and a memory storage device 83. These elements are coupled together, such that activation of the actuator 40 will spray fluid, activate the camera 80, activate the light unit 81, and the memory storage device 83. Therefore, the user will activate the actuator 40 to spray the victim and a picture illuminated by a flash will be taken and stored onto the memory device. Data can then be downloaded from the memory storage device to retrieve the photographic images. The photograph can then be used for identification purposes. Camera 80 could be used to take still pictures and capture video. In addition, the housing 20 could include a laser aiming device to ensure that the device is pointed at the proper target. This laser aiming device would also be coupled to the power source and memory storage device. The housing 20 could also include an audio recording device that would be coupled to the power source and memory storage device.

The invention claimed is:

1. A personal self defense device comprising:

a canister, the canister having a valve, a valve stem, and containing fluid;

an actuator, the actuator having a through orifice in communication with a nozzle and the valve stem, wherein depression of the actuator causes the release of fluid from the canister;

a housing, the housing having an interior to support the canister ends without completely encapsulating the canister, the housing having:

a front wall, the front wall having an aperture aligned with the nozzle, wherein fluid leaving the nozzle travels through the aperture;

a grip section, the grip section extending the length of the canister and terminating at a bottom section;

a top wall, the top wall having a cylindrical bore, the cylindrical bore sized to receive a top flap, the top flap pivotally received with the cylindrical bore and movable in a direction upwards from the housing;

the bottom section having a socket, the socket opening orientated perpendicular to the grip section and the bottom section having a means to adjust the diameter of the socket;

a rear wall; and a channel, the channel perpendicular to the canister and extending from the front wall to the rear wall;

a slide plate, the slide plate moveably received in the channel, the slide plate having:

a central aperture, the central aperture sized to allow receipt of the actuator, wherein movement of the slide plate disrupts the receipt of the actuator within the central aperture preventing depression of the actuator; and an incline aperture, the incline aperture shape being angular;

a shaft, the shaft located in the grip section parallel to the canister and movable, the shaft having:

a top end, the top end having a inclined block, the inclined block sized for receipt within the incline aperture;

a bottom end, the bottom end terminating within the socket; and an elastic member, the elastic member mounted on the shaft and biased in a direction parallel to the shaft;

a ball, the ball sized for removable receipt in the socket and capable of both rotational and angular movement while retained within the socket, wherein the ball can be removed from the socket by force from multiple angles and directions, the ball having:

a upper end, the upper end in frictional communication with the shaft when the ball is received within the socket, wherein receipt of the ball within the socket loads the elastic member moving the shaft and the incline block into the incline aperture aligning the central aperture with the actuator; and a lower end, the lower end having a stud, the stud having a bore for the attachment of a strap.

2. The self defense device as claimed in claim 1, wherein the housing comprises:

a camera, the camera in communication with the actuator and capable of taking still or video pictures;

a light source, the light source in communication with the actuator;

a memory storage device; and a power source, the power source in communication with the camera, the light source, and the memory storage device, wherein depression of the actuator will cause fluid to be released, the light to be illuminated, the camera to be turned on, and the images produced by the camera stored in the memory storage device.

3. The self defense device as in claim 1, wherein the housing comprising:

a audible generating device in communication with the power source and the actuator; and a speaker in communication with the audible generating device, the power source, and the actuator, wherein depression of the actuator generates an audible noise.

4. The self defense device as claimed in claim 1 comprising:

the housing having a through hole aligned with the slide plate; and the slide plate having an indicator visible via the through hole, wherein the user will be able to discern whether the slide plate is in alignment with the actuator allowing fluid to be released.

5. The self defense device as claimed in claim 4 comprising:

the shaft having a spline, the housing having a plurality of transverse support ribs perpendicular to the canister, the transverse support ribs having a notch sized to movably receive the spline, wherein the transverse support ribs support the spline maintaining alignment of the shaft.

6. The self defense device of claim 5, wherein the means to adjust the socket diameter comprises:

a screw with elastic member, wherein tightening or loosening of the screw adjusts the diameter of the socket relative to the diameter of the ball to adjust the amount of force required to insert or remove the ball.

7. The self defense device of claim 6, wherein the housing comprises two halves joined together.

* * * * *